United States Patent [19]

Tanida et al.

[11] Patent Number: 4,892,242

[45] Date of Patent: Jan. 9, 1990

[54] METHOD AND DEVICE FOR SEPARATING TRIMMING LOSSES OF PRODUCTS FORMED FROM SHEET

[75] Inventors: Osamu Tanida, Nara; Yoshiharu Okuno, Kyoto; Katsuhiko Yoshida, Nara; Nobuyasu Sakamoto, Nara; Hsao Ishikawa, Nara; Eiichi Kobayashi, Nara, all of Japan

[73] Assignee: Sekisui Kaseihin Kogyo Kabushiki Kaisha, Nara, Japan

[21] Appl. No.: 143,478

[22] Filed: Jan. 13, 1988

[51] Int. Cl.[4] ..... B26F 3/02

[52] U.S. Cl. ..... 225/2; 225/97; 225/103; 83/100; 83/146

[58] Field of Search ..... 225/94, 95, 96, 97, 225/100, 101, 103, 104, 105, 93, 2; 83/146, 145, 111, 109, 103, 102, 100, 451

[56] References Cited

U.S. PATENT DOCUMENTS

| | | | |
|---|---|---|---|
| 1,451,610 | 4/1923 | Gestas | 83/100 |
| 3,088,353 | 5/1963 | Hanington | 83/100 |
| 3,249,272 | 5/1966 | Scarpa | 225/97 X |
| 3,371,584 | 3/1968 | Zernov | 225/97 X |
| 3,439,848 | 4/1969 | Schwarzkopf | 225/96 |
| 3,459,350 | 8/1969 | Weahn | 225/94 X |
| 4,108,343 | 8/1978 | Vossen | 225/97 X |
| 4,425,829 | 1/1984 | Kranik et al. | 83/100 X |

FOREIGN PATENT DOCUMENTS

| | | |
|---|---|---|
| 61-7920 | 3/1986 | Japan . |
| 62-7396 | 1/1987 | Japan . |
| 62-7397 | 1/1987 | Japan . |

*Primary Examiner*—Frank T. Yost
*Assistant Examiner*—Rinaldi Rada
*Attorney, Agent, or Firm*—Armstrong, Nikaido, Marmelstein, Kobovcik, Murray

[57] ABSTRACT

A method and device are provided for separating trimming losses from a sheet having a plurality of products formed thereon with star-shaped scraps between the products. In one embodiment, the sheet is placed on a sheet supporting plate. The sheet is positioned between a blanking plate and a plurality of pushing rods fixed to a mounting plate. Each of the pushing rods has a piercing pin extending from the free end thereof for penetrating into a corresponding star-shaped scrap. The blanking plate has through holes formed therein which correspond to the pushing rods and star-shaped scraps such that the pushing rod passes through a corresponding through hole. The inner diameter of each through hole is smaller than the outer size or greatest dimension of the star-shaped scrap. When the star-shaped scrap is pushed through the through hole by the pushing rod, it deforms and passes through the through hole. After passing through the through hole, it returns to its original shape and because its outer size is greater than the diameter of the through hole, the star-shaped scrap cannot pass back through the through hole when the pushing rod is drawn back through the through hole. A collection chamber is positioned on the surface of the blanking plate for collecting the star-shaped scraps pushed through the through holes. A vacuum system removes the star-shaped scraps from the collection chamber. Additional embodiments of the method and device are also disclosed.

14 Claims, 5 Drawing Sheets

METHOD AND DEVICE FOR SEPARATING TRIMMING LOSSES OF PRODUCTS FORMED FROM SHEET

BACKGROUND OF THE INVENTION

1. Field of the Invention:

The present invention relates to a method and device for separating trimming losses of products formed from sheets and more particularly a method and device for blanking star-shaped trimming losses or scraps formed between adjacent formed products when a plurality of products are formed from a synthetic resin sheet to thereby completely separate the star-shaped scraps from the formed products.

2. Description of the Prior Art:

A plurality of formed products such as vessels, trays and the like having the same shape are formed from a sheet of a synthetic resin such as foamed polystyrene. A thermal forming process is used such as a vacuum forming process, a pressurized chamber forming process, a pressing process or the like. A trimming process is used to separate the formed products from each other.

In trimming the formed products, Thomson cutting blades or the like are used to define shearing lines around the outer peripheries of the formed products. Parts of the shearing lines are not completely cut and are left as connecting parts so that the formed products are not separated from each other. Thereafter, only the formed products are blanked by a mechanical press so that frame-shaped loss parts or scrap around the blanked products and the products themselves are separated from each other and the products thus formed are recovered.

When the outer peripheral continuous frame-shaped trimming-loss portions or scraps of the sheet are securely clamped by suitable means, it becomes relatively simple to separate the formed products from the frame-shaped scraps. Meanwhile, star-shaped trimming losses or scraps are left on portions of the sheet where the corners of the formed products are adjacent to each other. Many star-shaped scraps are separated from each other and are extremely small in size thus, a problem arises in that it is difficult to hold or clamp each star-shaped scrap and consequently it is difficult to separate them from the formed products.

In order to overcome the above-mentioned problem, Laid-Open Japanese patent application Ser. No. 61-7920 has disclosed a method in which after the formed products are trimmed, the star-shaped scraps are blanked and removed and then the formed products are separated from their outer peripheral frame-shaped scraps and recovered. In this method, in order to separate and remove a large number of star-shaped scraps, knock pins are pressed against the star-shaped scraps and are received by sheet-like jigs so that the star-shaped scraps are blanked and separated from the formed products.

However, according to the above-mentioned method, when the star-shaped scraps are blanked by the knock pins, static electricity is produced and the trimming scraps may adhere to the formed products such as food containers, trays or the like. This phenomenon is one of the most serious defects because in many cases, food is contained in the formed products.

Furthermore, in the case of the device of the type disclosed in the above-mentioned Laid-Open Japanese patent application Ser. No. 61-7920, the knock pins are pressed against the upright plate-shaped jigs. As a result, the separated star-shaped scraps are inclined so that they do not smoothly drop in the receiving holes. This phenomenon is also the cause of the adhesion of the star-shaped scraps to the formed products.

SUMMARY OF THE INVENTION

In view of the above, one of the objects of the present invention is to substantially solve the above-described technical problems of the prior art methods.

Another object of the present invention is to provide a method and device for positively separating the star-shaped scraps from products in the trimming step of the produced formed products from a sheet.

A further object of the present invention is to provide a method and a device for preventing a large number of star-shaped scraps, resulting from a continuous operation carried out for a long period of time, from adhering to and mixing with the formed products.

A still further object of the present invention is to provide a method and a device for efficiently separating and removing the star-shaped scraps from a formed products.

Yet another object of the present invention is to provide a method and a device for enabling the efficient automation of the step of trimming products formed from a sheet by completely separating star-shaped scraps from formed products.

BRIEF DESCRIPTION OF THE DRAWINGS

A first preferred embodiment of the present invention is shown in FIGS. 1–11.

A second preferred embodiment of the present invention is shown in FIGS. 12–18.

Figure 12:
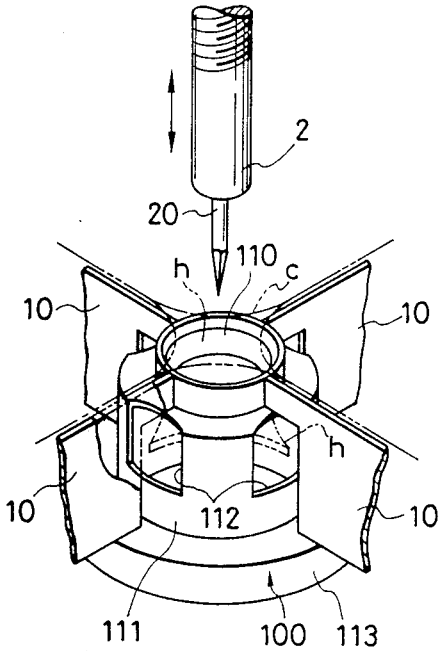
Figure 13:
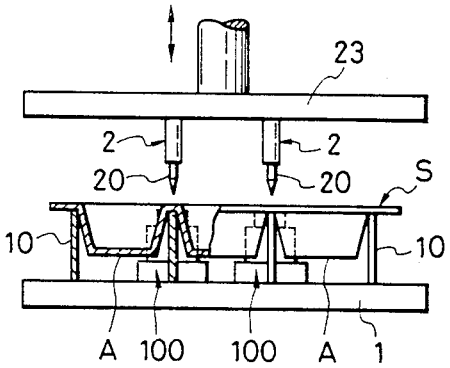

FIG. 12 is a perspective view of the second preferred embodiment of the present invention;

FIG. 13 is a schematic sectional view illustrating the entire second preferred embodiment; and FIGS. 14–18 are partial sectional views used to explain the sequence of the trimming steps in accordance with the second preferred embodiment.

Figure 19:
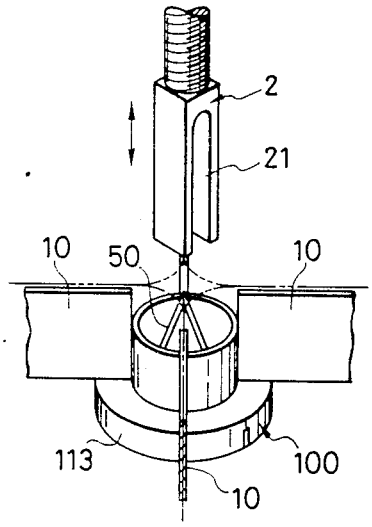
Figure 20:
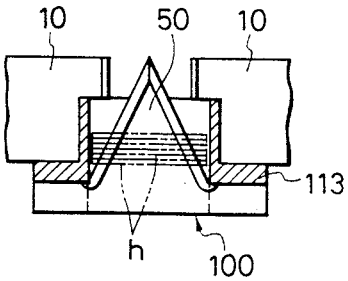
Figure 21:
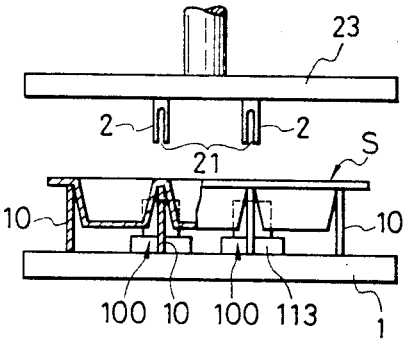

A third preferred embodiment of the present invention is shown in FIGS. 19–21.

FIG. 19 is a perspective view of a third embodiment of the present invention;

FIG. 20 is a sectional view of a bush used in the present invention; and

FIG. 21 is a schematic sectional view illustrating the entire trimming device in accordance with the third preferred embodiment.

DETAILED DESCRIPTION OF THE PREFERRED EMBODIMENTS

The preferred embodiments of the present invention will be described in detail hereinafter in conjunction with the accompanying drawings.

Figure 2:
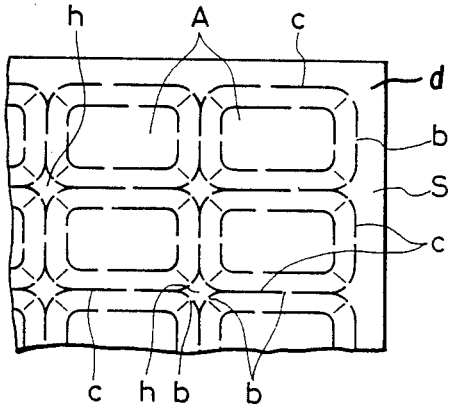
FIG. 2 is a partial top view illustrating products formed from a sheet.

The trimming loss portion separating method in accordance with the present invention is used in connection with a sheet S shown in FIG. 2. Products having the same size are formed by a thermal vacuum forming or drawing method. In the first preferred embodiment, a plurality of products A which are food containers substantially rectangular in shape, are formed in a matrix form. The sheet S may be a rectangular plate-shaped sheet blanked to have a predetermined area. Alternatively, the products A may be formed in a single array from a long sheet.

The sheet S with the formed products A has cutting lines c previously trimmed around the outer peripheries of the products A. The cutting lines are interconnected to each other through connecting portions b. The cutting lines c on the outermost periphery of each product A becomes a continuous frame-shaped trimming loss portion or scrap d and a portion surrounded by the cutting lines c of the adjacent products A becomes a star-shaped trimming-loss portion or scrap h, substantially in the form of a diamond. The cutting lines surrounding such star-shaped scrap h are also interconnected to each other by the connecting portions b so that each star-shaped scrap h is not separated from the surrounding products A and is, therefore, maintained integral therewith.

Figure 1:
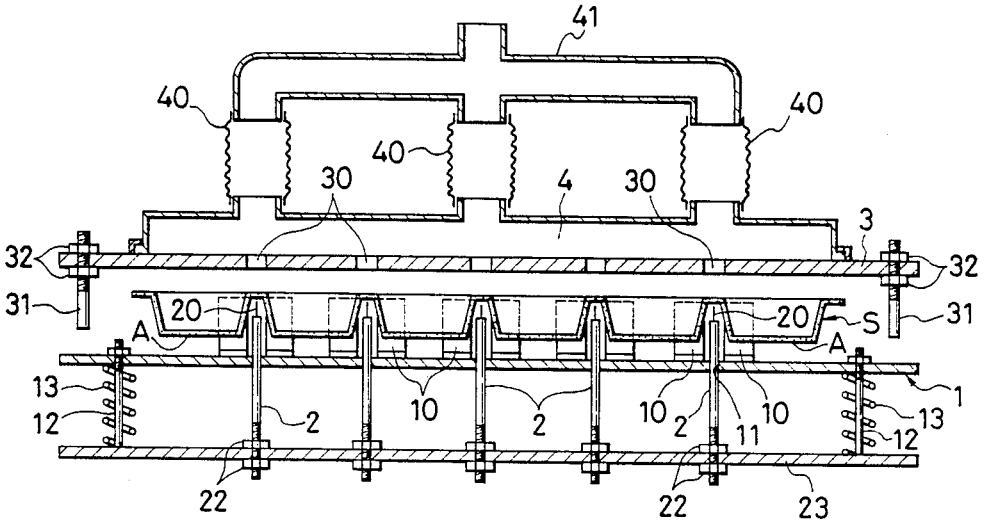
FIG. 1 is a sectional view of the entire first embodiment of the invention.
Figure 3:
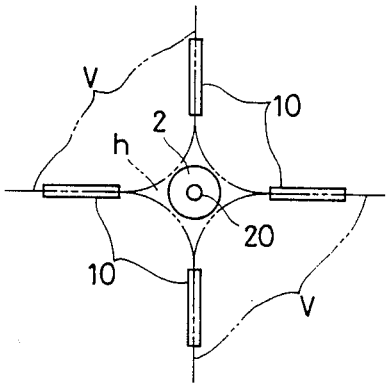
FIG. 3 is a top view, on an enlarged scale, illustrating supporting walls used in the present invention.
Figure 4:
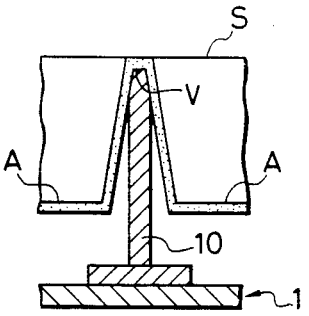
FIG. 4 is a partial sectional view illustrating major component parts of the first preferred embodiment of the present invention.

A device for separating and removing only the star-shaped scraps h from the sheet S in accordance with the present invention is shown in FIGS. 1, 3 and 4.

A sheet supporting plate 1 supports the sheet S in such a way that the expanded portions of the products A are directed downward. As shown in FIGS. 3 and 4, four thin-plate-shaped supporting walls 10 are disposed upright and equiangularly about the center which is the star-shaped scraps h, under the lower surface of the sheet S along the valleys V defined by the adjacent products A. The supporting walls 10 are inserted into the valleys V defined by the adjacent products A to support the sheet S. The supporting walls 10 extend outward from the outer periphery of each star-shaped scrap h so that they will not adversely affect the step of separating and removing the star-shaped scrap h which is described in detail hereinafter. Each of the supporting walls 10 is tapered upwardly so that the thickness of the upper portion thereof is thinner than the base portion thereof. Therefore, even when the valleys defined between the adjacent products A are narrow, it is easy to insert the supporting walls 1? into the respective valleys V. The sheet S is supported by the upper ends of the supporting walls 10 so that it can be correctly positioned with respect to the sheet supporting plate 1.

A star-shaped scrap pushing rod 2 in the form of a fine round rod has a needle-shaped piercing rod 20 extending coaxially upright from the upper end thereof. The piercing rod 20 is adapted to penetrate into each star-shaped scrap h. A plurality of such pushing or penetrating rods 2 extend from the upper surface of a mounting plate 23 disposed below the sheet supporting plate 1 in opposed relationship with respective star-shaped scraps h of the sheet S. The lower end portion of each pushing rod 2 is securely joined to the mounting plate 23 with nuts 22 so that the height which the pushing or penetrating rod 2 extends upwardly from the mounting plate 23, can be adjusted as required. Each pushing or penetrating rod 2 is vertically movably extended through a through hole 11 formed through the sheet receiving plate 1, and the upper end of the piercing rod 20 of each pushing or penetrating rod 2 is positioned in an opposed relationship with the center on the undersurface of each star-shaped scrap h.

Columns 12 extend upwardly from the mounting plate 23 and are inserted through the holes of the sheet supporting plate 1 so that the mounting plate 23 is vertically movable with respect to the sheet supporting plate 1. Springs 13 are position the sheet supporting plate 1 and the mounting plate 23 so that the sheet supporting plate 1 can be elastically and vertically moved.

A star-shaped scrap blanking plate is disposed above the sheet supporting plate 1 such that the blanking plate 3 can be vertically moved toward or away from the sheet supporting plate 1 by a cylinder mechanism or other suitable reciprocating means. The blanking or pushing plate 3 is formed with a plurality of through holes 30 which are in an opposed relationship with respect to star-shaped scraps h and are slightly smaller in size than the star-shaped scraps h. Pushing rods 31 extend downwardly from the blanking plate 3 at the four corners thereof and, as will be described in detailed hereinafter, are brought into contact with the sheet supporting plate 1 when the blanking plate 3 is moved downwardly, thereby pushing plate 1 downwardly. Each pushing rod 31 is fixed to the blanking plate 3 using nuts 32 so that the length of the downwardly extended pushing rod 31 can be adjusted.

A collection chamber 4 is formed integrally with the back surface of the blanking plate 3 for receiving therein star-shaped scraps h separated from the sheet S. The chamber 4 communicates with three-branched ends of a vacuum suction pipe 41 through suction hoses 40. The other end of the suction pipe 41 is connected to a vacuum source such as a blower and a star-shaped scrap collection container or the like. It should be noted that the expandable suction hoses 40 absorb the variations in distance between the stationary vacuum suction pipe 41 and the vertically movable collection chamber 4.

Referring next to FIGS. 1 and 5–11, the mode of operation of the device for separating the trimming-loss portions using the above-mentioned construction will be described.

First, as shown in FIG. 1, the trimmed sheet S is placed on the supporting walls of the sheet supporting plate 1 in such a way that each star-shaped scrap h is located at the center of a set of four supporting walls 10.

Figure 5:
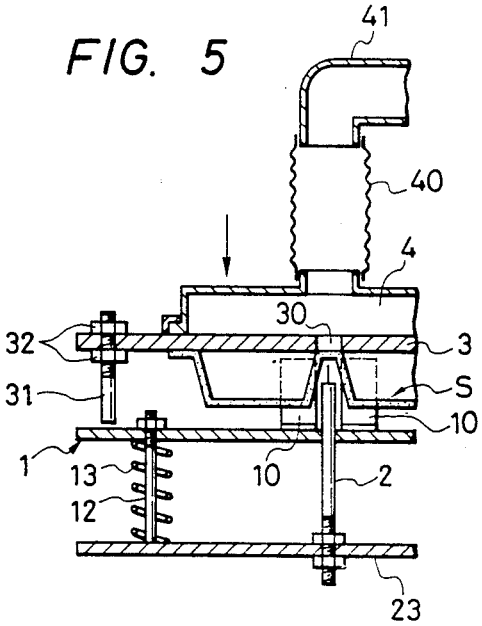
FIGS. 5–7 are sectional views used to explain the sequence of trimming steps in the first preferred embodiment.

Next, as shown in FIG. 5, the blanking plate 3 with the collection chamber 4 is moved downwardly so that the lower end of each supporting rod 31 extending from the undersurface of the blanking plate 3 is brought into contact with the sheet supporting plate 1 and the blanking plate 3 is brought into contact with the upper surface of the sheet S. The length of each supporting rod 31 has been previously adjusted depending upon the distance between the sheet supporting plate 1 and the upper surface of the sheet S.

Figure 6:
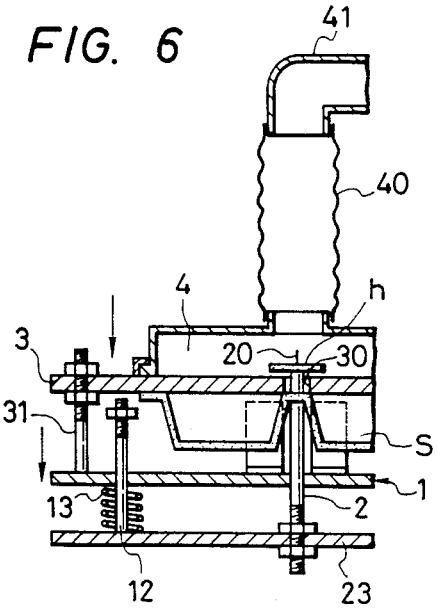
Figure 7:
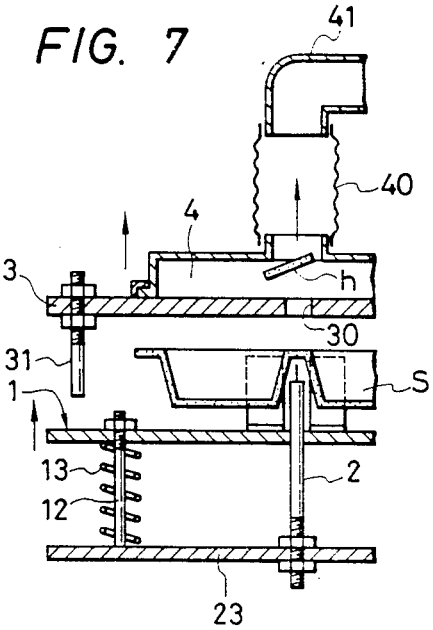

Thereafter, as shown in FIG. 6, the blanking plate 3 is further moved downwardly so that the sheet supporting plate 1 and the sheet S which are in contact with the lower ends of the supporting rods 31, are forced to move downwardly against the force of the springs 13 positioned between the sheet supporting plate 1 and the mounting plate 23. The piercing rod 20 extending upwardly from the upper end of each pushing rod 2, penetrates into the star-shaped scrap h. The sheet S is then forced to move further downwardly so that each star-shaped scrap is separated from the sheet S. When each pushing rod 2 is inserted into the corresponding through hole 30 of the blanking plate 3, each star-shaped scrap h penetrated by the piercing rod 20 is elastically deformed to pass through the corresponding through hole 30 into the collection chamber 4. Therefore, each pushing rod 2 passes through the corresponding through hole 30 into the collection chamber in a positive manner. Prior to the piercing operation, the length of each pushing rod 2 extending upwardly from the mounting plate 23, is adjusted so that the upper end of the piercing rod 20 is located below the processed sheet S.

Figure 8:
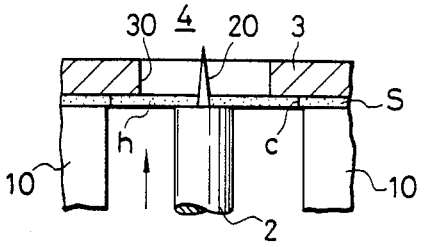
FIGS 8–11 are schematic sectional views used to explain in detail the sequence of the trimming steps of the first preferred embodiment.
Figure 9:
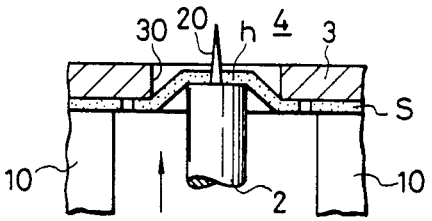
Figure 10:
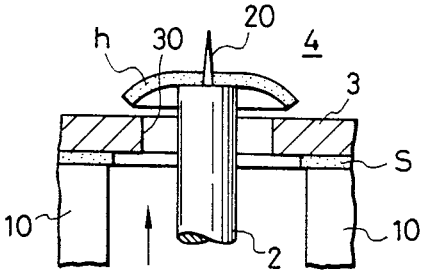
Figure 11:
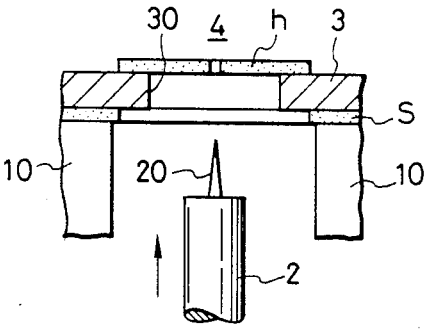

The above-described piercing steps are shown in more detail in FIGS. 8–10. First, as shown in FIG. 8, each piercing rod 20 penetrates into the lower surface of each star-shaped scrap h of the sheet S which is clamped securely between the blanking plate 3 and the supporting walls 10. Then, as shown in FIG. 9, each pushing rod 2 is inserted into the corresponding through hole 30 of the blanking plate 3 so that the star-shaped scrap h is pierced and separated from the remaining portion of the sheet S along the cutting lines defining the star-shaped scrap h. Next as shown in FIG. 11, when each pushing rod 2 passes through the corresponding through hole 30 into the collection chamber 4, each star-shaped scrap is forced to be elastically deformed in the through hole 30 which is smaller in size than the outer shape of the star-shaped scrap h and when the separated star-shaped scrap h is completely pushed into the collection chamber 4, the deformed star-shaped scrap h is restored to its original shape.

After the star-shaped scraps h are separated from the sheet S in the manner described above, the blanking plate 3 with the collection chamber 4 is moved upwardly and the push rod 2 is moved downwardly through the through hole 30. Each star-shaped scrap h which has been forced into the collection chamber 4 defined at the upper surface of the blanking plate 3 cannot pass through the through or piercing hole 30 so that it is thus, separated from the piercing rod 20 and remains in the collection chamber 4 as shown in FIG. 11. When the blanking plate 3 is further moved upwardly and the sheet supporting plate 1 is returned to its original position under the force of the springs 13, the interior of the collection chamber 4 is evacuated through the vacuum suction pipe 41 so that the pierced star-shaped scraps h are drawn from the collection chamber 4 through the suction hoses 40 and the suction pipe 41.

After the star-shaped scraps h are separated from the sheet S in the manner described above, the pierced sheet S is removed and replaced by a new processed sheet and the same piercing process described above is repeated, whereby the processed sheets S can be continuously pierced.

In the piercing process using the above-described device, the supporting walls 10 extend upwardly from the upper surface of the sheet supporting plate 1 so that deformation of the formed products A and the resulting damage thereto can be avoided. The axis of each pushing rod 2 can be accurately aligned with the corresponding through or piercing hole 30 so that the piercing process for separating the star-shaped scraps positively separates the star-shaped scraps from the sheet S. Instead of the abovementioned construction consisting of the sheet supporting plate 1 and the supporting walls 10, other suitable clamping mechanisms or supporting mechanisms which are used when the products are formed from a sheet S can be also used to hold the processed sheet S at a predetermined position as described above.

In order to cut out the star-shaped scraps h from the sheet S, it suffices that each pushing rod 3 penetrates into the corresponding star-shaped scrap and passes through the through hole 30 to push the star-shaped scrap h into the collection chamber 4. It follows, therefore, that the same effect as described above can be attained even when one of the sheet S, the pushing rods 2 or the blanking plate 3 are held stationary. For instance, in the case of the device of the first preferred embodiment of the present invention, the blanking plate 3 can be maintained stationary while the pushing rods 2 can be vertically moved by a suitable cylinder mechanism.

According to the above-described piercing process and device, the steps for penetrating each pushing rod 2 into the corresponding star-shaped scrap h from the lower surface thereof and forcing the cut-out star-shaped scrap h through the piercing hole 30 into the collection chamber 4 and supporting the sheet at a predetermined position can be carried out in a simple manner. It is to be understood that instead of the above-described method and device, each pushing rod 2 can penetrate into the corresponding star-shaped scrap from the upper surface thereof, force the cut-out star-shaped scrap h into a collection chamber 4 defined under the blanking plate 3 through the piercing hole 30.

The shape of the piercing holes 30 of the blanking plate 3 is not limited to diamond shape. Piercing holes of various shapes such as a circular shape, a rectangular shape, a polygonal shape, etc. can be used as long as their sizes are smaller than the greatest diameter of the star-shaped scraps which is substantially in the form of a diamond.

Referring next to FIGS. 12 and 13, a second preferred embodiment of the present invention will be described.

Bushes 100 are securely mounted on the sheet supporting plate 1 for supporting the sheet S when the star-shaped scraps h are cut out and a pushing cylinder 110 having an inner diameter smaller than the outer shape of the star-shaped scraps h, extends upwardly from the top of each bush 100. The upper inner periphery of each pushing cylinder 110 is countersunk so that a star-shaped scrap h can be smoothly pushed into the pushing cylinder 110 as will be described in detail hereinafter. A star-shaped scrap passage cylinder 111 (to be referred to as the "passage cylinder" hereinafter in this specification), which has a greater inner diameter than the pushing cylinder 110 permits the passage of the cut-out star-shaped scrap h therethrough. The passage cylinder extends from the lower end of each pushing cylinder 110. The upper peripheral portion of each passage cylinder 111 is cut out to define windows 112, to ensure the smooth passage or drop of the star-shaped scraps h.

The lower end of the passage cylinder 111 terminates in a disk-shaped base 113 which is securely mounted on the sheet supporting plate 1 such that each of the bushes 100 is aligned with each of the star-shaped scraps of the formed sheet S.

Four vertical, thin plate-like supporting walls 10 are positioned radially outwardly and equiangularly from the outer cylindrical surface of each bush 100 and are securely held in position on the sheet supporting plate 1. When the sheet S is placed on the upper ends of the supporting walls 10 and bushes 100, the supporting walls 10 are inserted in the valleys, respectively, defined between the adjacent formed products A so that the sheet S can be securely held in position without being displaced or deformed during the piercing process.

Each pushing rod 2 is in the form of a round rod and a needle-like piercing pin or rod 20 extends downwardly from the lower end of each pushing rod 2 so that each piercing pin 20 penetrates into the corresponding star-shaped scrap h of the sheet S. As best shown in FIG. 13, in order to simultaneously cut out a plurality of star-shaped scraps h, a plurality of pushing rods 2 extend downward from the undersurface of the mounting plate 23 which is vertically moved by a suitable cylinder mechanism or the like.

The steps of the piercing process using the device of the second preferred embodiment of the present invention are shown in FIGS. 14–18.

Figure 14:
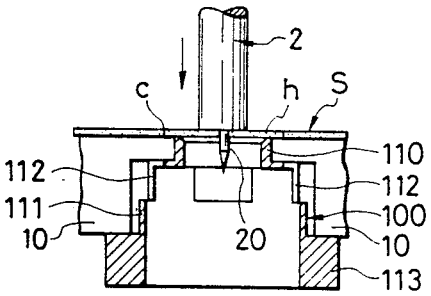

First, as shown in FIG. 14, the sheet S is placed over the bushes 100 such that the supporting walls 10 are inserted into the valleys defined by the adjacent drawn products A and the center of each of the star-shaped scraps h coincides with the center of each of the bushes 100.

Figure 15:
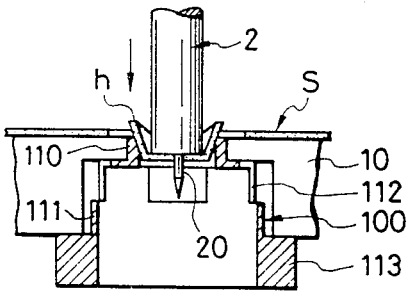

In this condition, the pushing rods 2 are moved downwardly so that they penetrate at the respective centers of the star-shaped scraps h and then push the scraps into the pushing cylinders 110. Then as shown in FIG. 15, each star-shaped scrap h pushed downwardly by each pushing rod 2 is deflected upwardly along its periphery and when it is pushed into the pushing cylinder 110, the star-shaped scrap h is cut out from the product A along the cutting lines which defines the star-shaped scrap h.

Figure 16:
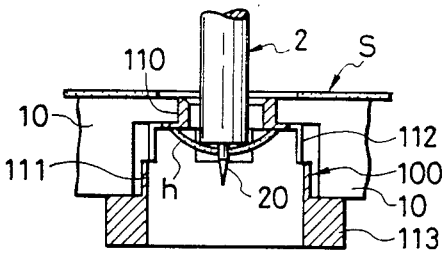

Next, as shown in FIG. 16, the pushing rod 2 is further pushed downwardly so that the star-shaped scrap h is forced into the passage cylinder 111 having a greater inner diameter and consequently the upwardly deflected peripheral portion of the star-shaped scrap h returns to its original horizontal position.

Figure 17:
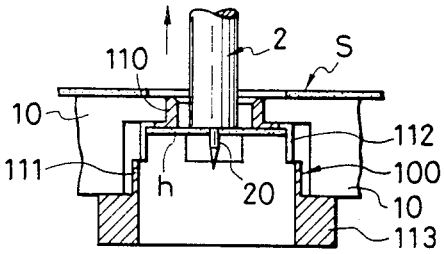
Figure 18:
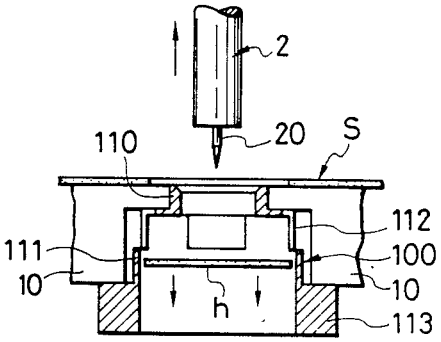

Thereafter, when the pushing rod 2 is moved upwardly as shown in FIG. 17, the outer peripheral portion of the star-shaped scrap h engages the lower end of the pushing cylinder 110 and thus, cannot pass back through the pushing cylinder 110.

Next, when the pushing rod 2 is pulled out of the pushing cylinder 110 to its original position above the bush 100, the piercing pin 20 is pulled out of the star-shaped scrap h which then drops in the passage cylinder 111. The star-shaped scraps h which have dropped out of the passage cylinders 111 are collected by a suitable collection means such as a vacuum collection system.

The star-shaped scraps h are thus cut out from the sheet S, separated from the products A and removed in the manner described above.

In the piercing device of the type just described above, the inner diameter of each pushing cylinder 110 which extends downwardly from each bush 100, is determined depending upon the outer diameter of each star-shaped scrap to be cut out and separated from the products so that the star-shaped scrap h can be easily and smoothly pushed into the pushing cylinder 110 and engage the lower end peripheral portion 110 in a positive manner when the pushing rod 2 is moved upwardly to its original position. That is, the inner diameter of the pushing cylinder 110 is selected smaller than the outer diameter or size of each star-shaped scrap h and is generally 20–30 mm. It is easy to fabricate the pushing cylinder 110 having a circular cross sectional configuration, but it is also possible to change its cross section depending upon the shape of each star-shaped scrap. For example, the pushing cylinder may have a polygonal cross section.

The inner diameter of the passage cylinder 111 is selected so that the star-shaped scrap h which has passed through the pushing cylinder 110 can be restored to its original shape in passage cylinder 111. Furthermore, the inner diameter of the passage cylinder 111 is determined .so that the star-shaped scrap can smoothly drop through the passage cylinder 111 without engaging the inner wall thereof. The passage cylinder 111 is thus effective as a separating mechanism and a guide mechanism for collecting the star-shaped scraps so that the cut-out star-shaped scraps will not adhere to the sheet S and other parts of the device. Thus, the cut-out star-shaped scraps h are smoothly collected. In addition, in order to accomplish the positive collection of the star-shaped scraps cut out from the sheet S, an inner space which is greater in size than the pushing cylinder 110 can be defined by suitable partition walls and guide members.

The windows 112 formed through the outer wall of the passage cylinder 111 permit the star-shaped scraps to drop without engaging with the inner wall of the passage cylinder and the positions of the windows 112 are so selected as to coincide with the outwardly extended pointed ends of the star-shaped scrap. It is, however, possible to eliminate windows 112 if the inner diameter of the passage cylinder 111 is sufficiently large so that the star-shaped scraps h can smoothly drop therethrough.

Referring next to FIGS. 19–21, a third preferred embodiment of the present invention will be described.

The sheet S is placed on the bushes 100 to cut out the star-shaped scraps h. Each bush 100 is in the form of a cylinder and its lower end terminates on a disk-shaped mounting base 113. As shown in FIG. 21, the mounting bases 113 are arranged on the sheet supporting plate 1 such t hat each bush 100 is in an opposed relationship with each star-shaped scraps h of the sheet S.

A cutter 50 in the form of a triangle is securely mounted within the bush 100 such that the cutting blades extend diametrically in the interior of the bush 100 and are directed upwardly. The upper vertex at the center of the cutter 50 extends slightly beyond the upper end of the bush 100.

Upright thin-plate-like supporting walls 10 extend upwardly from the sheet supporting plate 1 and extend radially outward from the bush 100 in an equiangularly spaced apart relationship. The upper ends of the supporting walls 10 extend upwardly beyond the upper end of each bush 100 so that they are at substantially the same height as the top vertex of the cutter. When the sheet S is placed on the upper ends of the supporting walls 10, the upper ends of the supporting walls 10 are inserted into the valleys defined between the adjacent drawn products A and contact the undersurface of the sheet S in such a manner that the axis of the bush 100 is accurately aligned with the axis of the star-shaped scrap h of the sheet S. The sheet S is thus securely placed at a predetermined position and is prevented from being displaced and deformed.

The pushing rod 2 downwardly cuts out the star-shaped scrap h so that the scrap is separated from the sheet S. As shown in FIG. 21, in order to cut out a plurality of star-shaped scraps simultaneously, a plurality of pushing rods 2 extend downwardly from the undersurface of the mounting plate 23 which is vertically movable by a suitable means such as a cylinder mechanism. The pushing rods 2 are in the form of a flat thin-plate and are formed with a vertical groove 21 extending from the lower end of the pushing rod 2 toward a point adjacent to the top end thereof along the axis thereof. The width of the vertical groove 21 is greater than the thickness of the cutter 50 and the length of the vertical groove 21 is selected so that when the pushing rod 2 is inserted into the bush 100 at the end of its maximum downward stroke, the upper end of the vertical groove 21 does not contact the cutter 50.

The star-shaped scraps of the sheet S can be positively cut out and separated from the sheet S in a manner substantially similar to that described above with reference to FIG. 12 except that the star-shaped scraps h are cut out by the cutter 50.

A further preferred embodiment of the present invention will be described hereinafter with reference to FIG. 12. An elastically vertically movable receiving member is disposed within the passage cylinder 111. A modified pushing rod 2 having no piercing pin 20, and the receiving member clamp the star-shaped scrap h and push it downwardly so that the star-shaped scrap h is cut out from the sheet S. Thereafter, the pushing rod 2 is moved upwardly and the star-shaped scrap h drops through the passage cylinder 111 and is removed.

The sheet S which is used in the methods and devices for separating the star-shaped scraps in accordance with the present invention may be, in addition to foamed sheets such as polystyrene foamed sheets made from various thermoplastic resins, non-foamed sheets made of various thermoplastic resins, laminated sheets consisting of foamed and non-foamed sheets or films which are formed with various products A such as cups, trays, etc.

As described above, according to the methods and devices for separating trimming losses in accordance with the present invention, only the star-shaped scraps h are forced into the collection chamber 4 through the piercing holes 30 or the pushing cylinders of the blanking plate 3 by the pushing rods 2 so that they are separated from the remaining portion of the sheet S.

When the piercing pin 20 extends from free end of each pushing rod 2, the star-shaped scrap is penetrated by the piercing pin 20 while being forced into the piercing hole 30 or the pushing cylinder 110 so that it is positively separated from or cut out from the sheet S. That is, there is no possibility that the star-shaped scraps are misaligned with the pushing rods 2 or the pushing rods 2 slip so that the star-shaped scraps remain at the sheet S or clog the piercing holes 30. Thus, the star-shaped scrap portions can be separated from the sheet S in a positive manner.

The star-shaped scrap is forced to pass through the piercing hole 30 and drop into the collection chamber 4, which is larger in size than the piercing hole 30, by the pushing rod 2 and when the pushing rod 2 is pulled out of the collection chamber 4, the star-shaped scrap h engages the outer peripheral portion of the outlet end of the piercing hole 30 which is smaller in size than the outer shape of the star-shaped scrap h, so that the piercing pin 20 is pulled out of the star-shaped scrap and the star-shaped scrap remains in the collection chamber 4. Therefore, there is no problem of the star-shaped scrap h being pulled back into the piercing hole 30 and adhering to the sheet S.

As a result, the star-shaped scraps h can be positively and automatically separated or cut out from the sheet S without the need of individually separating each star-shaped scrap from each piercing pin 20.

When the star-shaped scrap h engages the outer peripheral portion of the outlet side of the piercing hole 30 so as to be separated from the sheet S, the pushing rod 2 remains in an accurately aligned relationship with the star-shaped scrap h. Therefore, there is no possibility that the position of the star-shaped scrap is displaced so that the star-shaped scrap does not engage with the outer peripheral portion of the outlet side of the piercing hole 30 while the piercing pin 20 is in the penetrated state. In other words, the outer peripheral portion of the star-shaped scrap positively engages with the outer peripheral portion of the outlet side of the piercing hole 30 so that the pushing rod 2 can be positively separated from the star-shaped trimming loss portion h.

Furthermore, the star-shaped scraps are separated from the sheet S and forced to drop into the collection chamber 4 in the manner described above. Thereafter, the star-shaped scraps h in the collection chamber 4 are removed through the vacuum pipe 41 by the vacuum suction. Therefore, there is no problem of the separated star-shaped scraps being accumulated adjacent to the outlets of the piercing holes 30 to prevent the insertion of the pushing rods 2 or the pulling out of the piercing pins 20 from the star-shaped scraps.

Furthermore, when static electricity is generated when the sheets S are handled or while the piercing process is carried out such that the star-shaped scraps become electrically charged and adhere to the inner walls of the scrap collection chamber 4, the star-shaped scraps in the collection chamber 4 are forcibly transported by the vacuum suction to a recovery container or the like. Thus, it becomes possible that a large number of sheets S can be continuously pierced.

Moreover, the star-shaped scraps collected in the collection chamber 4 are transported by the vacuum suction so that regardless of the size and shape of the star-shaped scraps and the deformations thereof during the piercing process, the discharge of the star-shaped scraps out of the collection chamber 4 is not adversely affected at all and thus, the star-shaped scraps can be positively recovered or removed.

In addition, in accordance with the present invention, the separation device comprises the pushing rods 2, the piercing plate 3, the piercing holes or cylinders 110 and the vacuum suction system all of which are very simple in construction so that it is inexpensive and simple to fabricate the separating devices and furthermore, the inspection and maintenance of such devices are very much facilitated.

As described above, according to the method and device of the present invention, the star-shaped scraps can be positively separated or cut out from the sheet S and recovered. Even when the star-shaped scraps are electrostatically charged, they will not return to the sheet S once they are separated or cut out therefrom so that they are positively separated from the remaining portion of the sheet S and removed. Therefore, there is no fear that the separated star-shaped scraps will adhere to the sheet S. It follows, therefore, that the step of inspecting each of the products A in order to detect whether or not the separated star-shaped scraps are adhered to the products A can be completely eliminated and thus, the inspection cost of the products A can be reduced.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A device for separating trimming losses from a sheet having a plurality of products formed thereon with star-shaped scraps therebetween, said device comprising: a sheet supporting plate having support walls for supporting said sheet thereon with said support walls being positioned adjacent said star-shaped scrap; a blanking plate; a plurality of pushing rods extending through said sheet supporting plate each pushing rod having a free end for contacting and pushing a corresponding star-shaped scrap, said blanking plate and said pushing rods being disposed on opposite sides of said sheet for movement toward or away from each other; through holes formed in said blanking plate, wherein each pushing rod can pass through a corresponding said through hole and wherein an inner diameter of said through hole is smaller than an outer size of said star-shaped scrap; and a collection chamber positioned on a surface of said blanking plate opposite to the side on which the pushing rods are located for collecting said star-shaped scraps pushed through said through holes.

2. A device for separating trimming losses from a sheet as set forth in claim 1, wherein said sheet has valleys formed therein adjacent said products and wherein said support walls are inserted in said valleys.

3. A device for separating trimming losses from a sheet having a plurality of products formed thereon with star-shaped scraps therebetween, said device comprising a sheet supporting plate; a plurality of pushing rods, each pushing rod having a free end for contacting and pushing a corresponding said star-shaped scrap, said pushing rods and said sheet supporting plate being disposed on opposite sides of said sheet; a plurality of pushing cylinder means fixed to said sheet supporting plate, each pushing cylinder means corresponding to one of said pushing rods, wherein an inner diameter of said pushing cylinder means is less than an outer dimension of said star-shaped scraps an and wherein each said pushing rod pushes a corresponding star-shaped scrap through said pushing cylinder means; and collection chamber means positioned on the side of said sheet supporting plate opposite to the side of said sheet, wherein said star-shaped scraps are collected in said collection chamber after being pushed through said pushing cylinder means by said pushing rods.

4. A device for separating trimming losses from a sheet as set forth in claim 3, wherein said pushing cylinder means comprises a pushing cylinder having a diameter smaller than the outer dimension of said star-shaped scrap and a passage cylinder connected to said pushing cylinder, said passage cylinder having a diameter greater than the outer dimension of said star-shaped scrap, wherein said pushing rod pushes said star-shaped scrap through said pushing cylinder and into said passage cylinder such that said star-shaped scrap goes through said passage cylinder into said collection chamber.

5. A device for separating trimming losses from a sheet as set forth in claim 3, wherein said passage cylinder includes windows therein for enhancing the movement of said star-shaped scrap through said passage cylinder.

6. A device for separating trimming losses from a sheet as set forth in claim 3, wherein said pushing rod includes a piercing pin extending from the free end thereof, said piercing pin piercing, said star-shaped scrap.

7. A device for separating trimming losses from a sheet as set forth in claim 3, including a mounting plate, wherein said pushing rods are fixed to said mounting plate.

8. A device for separating trimming losses from a sheet as set forth in claim 3, wherein said sheet supporting plate has support walls for supporting said sheet thereon, said support walls being positioned adjacent said star-shaped scrap.

9. A device for separating trimming losses from a sheet as set forth in claim 8, wherein said sheet has valleys formed therein adjacent said products and wherein said support walls are inserted in said valleys.

10. A device for separating trimming losses from a sheet having a plurality of products formed thereon with star-shaped scraps therebetween, said device comprising: a sheet supporting plate; a plurality of pushing rods, each pushing rod having a free end for contacting and pushing a corresponding said star-shaped scrap, said pushing rods and said sheet supporting plate being disposed on opposite sides of said sheet; a plurality of bush means fixed to said sheet supporting plate, each bush means corresponding to one of said pushing rods, wherein each bush means has a cylinder portion and a cutter means positioned in said cylinder portion, and wherein each pushing rod has a groove having a thickness greater than a thickness of said cutter means, and wherein each of said pushing rods pushes a corresponding star-shaped scrap onto said cutter means and through said cylinder portion; and collection chamber means positioned on the side of said sheet supporting plate opposite to said sheet, wherein said star-shaped scraps are collected in said collection chamber after being pushed through said pushing cylinder means by said pushing rods.

11. A device for separating trimming losses from a sheet as set forth in claim 10, including a mounting plate, wherein said pushing rods are fixed to said mounting plate.

12. A device for separating trimming losses from a sheet as set forth in claim 11, wherein said sheet has valleys formed therein adjacent products and wherein said support walls are inserted in said valleys.

13. A method for separating trimming losses from a sheet having a plurality of products formed thereon with star-shaped scraps therebetween, said method comprising the steps of: pushing each star-shaped scrap with a leading end of a pushing rod to thereby force said star-shaped scraps through a corresponding pushing cylinder mounted on a sheet supporting plate in contact with a surface of said sheet and thereby separating said star-shaped scraps from said sheet, wherein an inner diameter of said pushing cylinders is smaller than an outer size of said star-shaped scraps; depositing the star-shaped scraps thus separated into a collection chamber on a rear surface of said sheet supporting plate; and withdrawing said star-shaped scraps pushed into said collection chamber through a vacuum suction pipe communicating with said collection chamber by a vacuum suction process, thereby removing said star-shaped scraps from said collection chamber.

14. A method for separating trimming losses from a sheet having a plurality of products formed thereon with star-shaped scraps therebetween, said method comprising the steps of: pushing each star-shaped scrap with a leading end of a pushing rod to thereby force said star-shaped scraps through a corresponding bush means having a cylindrical portion and a cutter means mounted on a sheet supporting plate in contact with a surface of said sheet, thereby separating said star-shaped scraps from said sheet, wherein an inner diameter of said cylindrical portions is smaller than an outer size of said star-shaped scraps; depositing the star-shaped scraps thus separated into a collection chamber on a rear surface of said sheet supporting plate; and withdrawing said star-shaped scraps pushed into said collection chamber through a vacuum suction pipe communicating with said collection chamber by a vacuum suction process, thereby removing said star-shaped scraps from said collection chamber.

* * * * *